US005295515A

United States Patent [19]

Kato

[11] Patent Number: 5,295,515

[45] Date of Patent: Mar. 22, 1994

[54] APPARATUS FOR CONTROLLING WEFT INSERTION IN JET LOOM

[75] Inventor: Masahiko Kato, Kariya, Japan

[73] Assignee: Kabushiki Kaisha Toyoda Jidoshokki Seisakusho, Kariya, Japan

[21] Appl. No.: 838,059

[22] Filed: Feb. 19, 1992

[30] Foreign Application Priority Data

Feb. 25, 1991 [JP] Japan ..... 3-030471

[51] Int. Cl.[5] ..... D03D 47/30

[52] U.S. Cl. ..... 139/435.1; 364/274.6; 364/470; 364/921.1; 395/61; 395/900; 139/435.2; 139/435.5; 139/452

[58] Field of Search ..... 364/921.1, 470, 274.6; 139/435.1, 435.5, 435.2, 452; 395/900, 61

[56] References Cited

U.S. PATENT DOCUMENTS 4,901,770 2/1990 Takegawa ..... 139/435.2
5,031,669 7/1991 Wahhoud et al. ..... 139/435.5 X
5,101,867 4/1992 Tsutomo et al. ..... 139/435.2

FOREIGN PATENT DOCUMENTS 0290975 11/1988 European Pat. Off. .
0306998 3/1989 European Pat. Off. .
0442546 8/1991 European Pat. Off. .
0458753 11/1991 European Pat. Off. .
92810126 6/1992 European Pat. Off. .
62-117853 5/1987 Japan .
64-3969 1/1989 Japan .
2-210044 8/1990 Japan .

*Primary Examiner*—Andrew M. Falik
*Attorney, Agent, or Firm*—Brooks Haidt Haffner & Delahunty

[57] ABSTRACT

In a jet loom, a weft insertion start timing, a jet injection start timing of a main weft inserting nozzle and a jet injection stop timing of auxiliary weft inserting nozzles are controlled on the basis of empirical rules. A weft insertion control program incorporating the empirical rules is provided for a control computer for controlling an energization start timing of a solenoid, an energization start timing of an electromagnetic valve and a deenergization timing of an electromagnetic valve on the basis of the weft insertion start timing obtained from a weft release detector and the weft leading end arrival timing obtained from a weft detector. The control program is so prepared as to detect the control quantities for the detected data on the basis of specific correspondence relations between sequential arrayed data including a plurality of weft insertions start timing data and a plurality of weft leaving and arriving timing data, both data being classified in a particular order in accordance with empirical rules, and sequentially arrayed control quantities also classified in a particular order in accordance with an empirical rule.

4 Claims, 17 Drawing Sheets

APPARATUS FOR CONTROLLING WEFT INSERTION IN JET LOOM

BACKGROUND OF THE INVENTION

1. Field of the Invention

The present invention generally relates to a weft insertion control apparatus in a jet loom. More particularly, the invention is concerned with a weft insertion control apparatus for a jet loom for controlling insertion of a weft into a warp shed under the action of air jet injected by a main weft inserting nozzle after the weft is released from a retaining action of a weft release stop mechanism capable of being changed over between a weft retaining state in which the weft is prevented from being drawn and a state in which the weft is released from the retained state.

2. Description of the Prior Art

For a jet loom, it is important for weaving a fabric of high quality to realize satisfactory conditions for insertion of a weft in which the leading end of the weft is caused to reach a weft arrival terminal position at a predetermined timing. As control factors or quantities which can affect the conditions for the weft insertion, there may be mentioned, for example, a weft insertion start timing at which the weft insertion commences and air jet injection timings of main and auxiliary weft inserting nozzles. In Japanese Unexamined Patent Application Publication No. 117853/62 (JP-A-62-117853), there is disclosed a weft insertion control mechanism which is so arranged as to compare an actual weft leading end arrival timing (i.e. time point at which the leading end of the weft reaches a predetermined goal or terminal position located widthwise of woven fabric) with a preset arrival timing to thereby control a weft release start timing of a weft retainer pin provided in association with a winding type weft length measuring-/reserving device.

According to the prior art weft insertion control technique mentioned above, when the leading end of the weft as inserted has reached the predetermined goal position later than the preset time point, the weft insertion start timing is advanced correspondingly for a predetermined time, while the weft insertion timing is delayed correspondingly when the leading end of the inserted weft has reached the goal position earlier than the preset time point.

In this conjunction, it is however noted that there may occur three different states "normal", "late" and "early", respectively, for the weft leading end to reach a predetermined weft insertion goal position, being correspondingly accompanied with three different weft insertion start time points or timings. As a result, as many as nine different sets are conceived as combinations of weft insertion start conditions and weft leading end arrival conditions. Moreover, when taking into consideration the magnitudes or extents of deviations of the weft insertion start timing and the weft leading end arrival timing from the respective preset time points, there exist an enormous number of weft insertion conditions which can be identified discriminatively from one another. For this reason, it is impossible with the prior art simple weft insertion control technique to realize a fine weft insertion control in which numerous and various conditions or states for the weft insertion are properly taken into account.

SUMMARY OF THE INVENTION

It is therefore an object of the present invention to provide a weft insertion control apparatus for a jet loom which apparatus is capable of optimally setting weft insertion control quantities such as weft insertion start timing, air-jet injection timings of weft inserting nozzles and the like by using empirically established rules of an expert who is skilled in determining and setting the weft insertion start timing and the weft leading end arrival timing on the basis of his or her experience.

In view of the above and other objects which will become more apparent, there is provided according to an aspect of the present invention a weft insertion control apparatus in a jet loom which comprises data input means for inputting data for a weft insertion start timing, a weft leading end arrival timing and others, and control quantity determining means for determining control quantities for a weft insertion timing, a weft carrying fluid injection timing and others on the basis of the input data supplied from the data input means, wherein the control quantity determining means includes control quantity selecting means for selecting control quantities for the input data on the basis of specific correspondence relations between a plurality of sequential data arrays resulting from classification of the data for the weft insertion in accordance with a sequencing rule and a plurality of sequential control quantity arrays classified in accordance with a sequencing rule.

According to another aspect of the present invention, there is provided for a jet loom in which a weft released from weft retaining action exerted by weft release control means capable of being changed over between a state in which the weft is allowed to be drawn and a state in which the weft is prevented from being drawn is inserted into a warp shed under the action of air jet injected by a main weft inserting nozzle, an apparatus for controlling the weft insertion which comprises weft insertion start timing detecting means for detecting a timing at which a weft is inserted, weft leading end arrival timing detecting means for detecting a timing at which the leading end of the weft arrives at a predetermined weft goal position, and control quantity determining means for determining weft insertion control quantities such as the weft release timing, the jet injection timing of the main weft inserting nozzle and others on the basis of the detected weft insertion start timing data and the detected weft leading end arrival timing data, wherein the control quantity determining means is imparted with a function for selecting the weft insertion state control quantities for the weft insertion start timing data and the weft leading end arrival timing data on the basis of specific correspondence relations between sequential data arrays including a plurality of weft insertion start timing data classified in a systematic order in accordance with predetermined weft insertion start timing sequencing rules and a plurality of weft leading end arrival timing data classified in a systematic manner in accordance with predetermined weft leading end arrival timing sequencing rules on one hand and a sequential data array including a plurality of control quantities classified in a systematic order in accordance with weft insertion control quantity sequencing rules on the other hand.

The weft insertion start timing data are classified into a plurality of sequentially arrayed weft insertion start timing data in accordance with sequencing rules defining the insertion start timing, for example, to be "early", "slightly early", "normal", "slightly late" and "late". On the other hand, the weft leading end arrival timing data are classified into a plurality of sequentially arrayed weft leading end arrival timing data in accordance with sequencing rules defining the arrival timing, for example, to be "late", "slightly late", "normal", "slightly early" and "early". Additionally, the weft insertion state control quantities such as the weft release timing of the weft release control means and the jet injection timing of the main weft inserting nozzle are classified into a plurality of sequentially arrayed control quantities by the sequencing rules defining the injection timing to be "late", "slightly late", "normal", "slightly early" and "early". Specific correspondence relations are established between the sequential arrays including the detected weft insertion timing data and the detected weft leading end arrival timing data on one hand and the sequential array including the control quantities or factors on the basis of the expert's empirical rules. The control quantity determining means determines the control quantities for the detected data of the weft insertion start timing and the weft leading end arrival timing on the basis of the above mentioned specific correspondence relations.

BRIEF DESCRIPTION OF THE DRAWINGS

The detailed description of the invention will be made with reference to the accompanying drawings, wherein like numerals designate corresponding parts.

DESCRIPTION OF THE PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

Now, referring to FIGS. 1 to 21, the present invention will be described in detail in conjunction with a preferred embodiment which incarnates the teachings of the invention.

Figure 1:
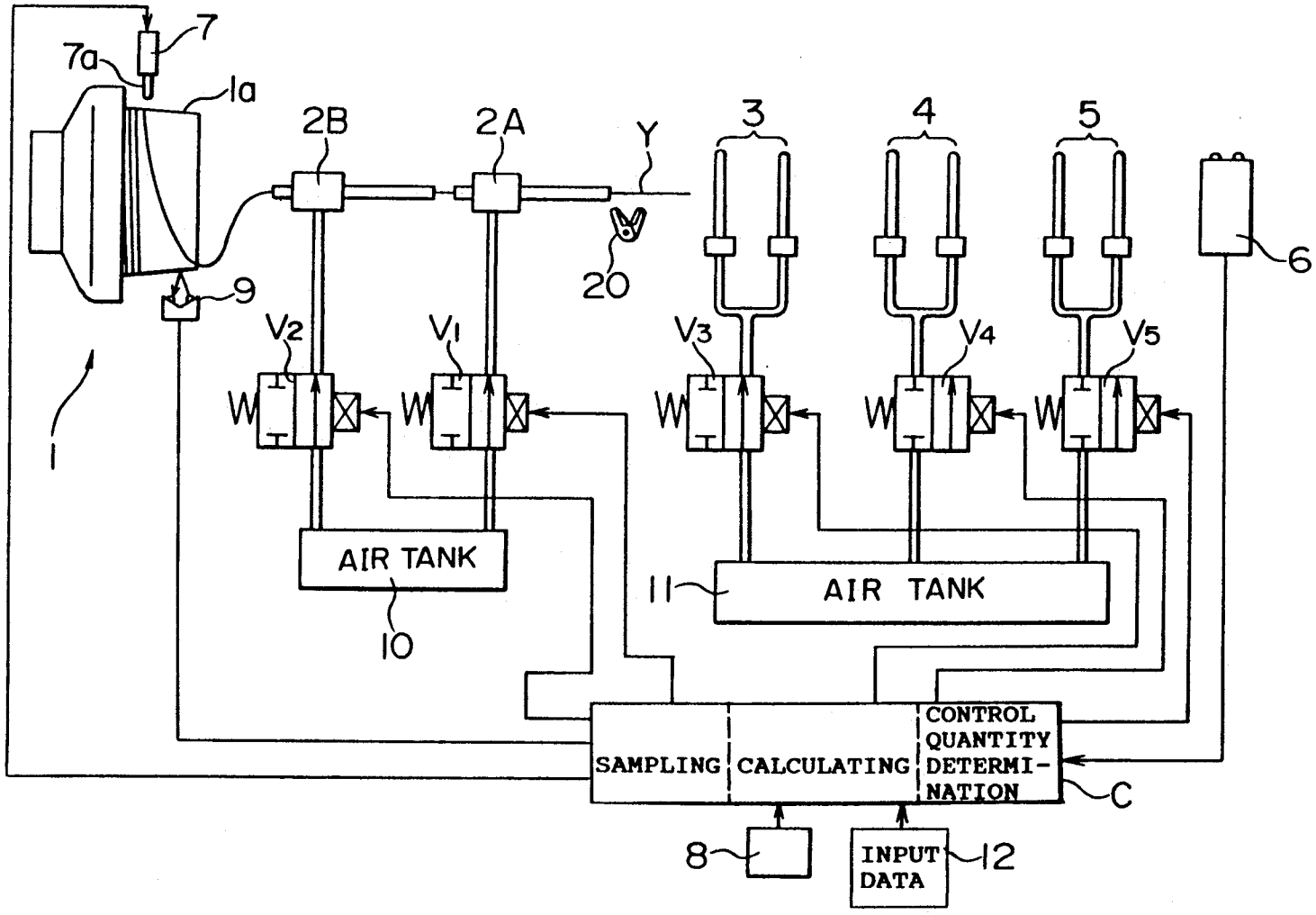
FIG. 1 is a schematic elevational view showing a general arrangement of a weft inserting apparatus to which the present invention is applied.

Referring to FIG. 1, a reference numeral 1 denotes generally a weft length measuring/reserving device of a weft winding type. A weft Y measured in length and stored or reserved in the weft length measuring/reserving device 1 is ejected through a main weft inserting nozzle 2A and subsequently undergoes weft insertion in a warp passage under the action of relaying air jets injected by a plurality of auxiliary weft inserting nozzles 3, 4 and 5. Interposed between the weft length measuring/reserving device 1 and the main weft inserting nozzle 2A is a tandem nozzle 2B which is provided for the purpose of promoting or facilitating injection of the weft by the main weft inserting nozzle 2A upon weft insertion.

When the weft has been inserted satisfactorily without failure, presence of the weft is detected by a weft detector 6 which may be constituted by a reflection type photoelectric sensor. In that case, the loom operation is continued. On the other hand, unless the weft detector 6 detects the presence of weft, the loom operation is stopped.

Retention of the weft for preventing it from being drawn out from a weft winding cylinder surface 1*a* of the weft length measuring/reserving apparatus 1 and release of the weft from the retained state are effectuated by electrically energizing and deenergizing a solenoid 7 which is adapted for actuating a retaining or stop pin 7*a*. The solenoid 7 and the retaining pin 7*a* constitutes a weft release control means. The energization/- deenergization control of the solenoid 7 is performed in accordance with commands issued by a control computer C. More specifically, the control computer C controls the energization/deenergization of the solenoid 7 on the basis of a loom rotational angle detection signal supplied to the control computer C from a rotary encoder 8.

Disposed in the vicinity of the weft winding cylinder surface 1*a* is a weft release detector 9 which may also be constituted by a reflection type photodetector. The weft detector 9 serves to detect the weft Y which is released from the retained state and drawn out from the winding cylinder surface 1*a* of the weft length measuring/reserving device. When the number of turns of the weft released, as detected by the weft release detector 9, has attained a predetermined value, the control computer C commands deenergization of the solenoid 7, as a result of which the retainer or stop pin 7*a* is brought into engagement with the weft winding cylinder surface 1*a* to thereby prevent the weft from further being drawn out (i.e. the weft is held in the retained state).

Pressurized air injection from the main weft inserting nozzle 2A is controlled by electrically energizing and deenergizing an electromagnetic valve $V_1$, while the pressurized air injection of the tandem nozzle 2B is controlled through energization/deenergization of an electromagnetic valve $V_2$. Further, pressurized air injections of the auxiliary weft inserting nozzles 3 to 5 are controlled through energization/deenergization of electromagnetic valves $V_3$, $V_4$ and $V_5$, respectively. The electromagnetic valves $V_1$ and $V_2$ are connected to a pressurized air supply tank 10, while the electromagnetic valves $V_3$ to $V_5$ are connected to another pressurized air supply tank 11. The energization/deenergization control of the individual electromagnetic valves $V_1$ to $V_5$ is performed in accordance with commands issued by the control computer C. More specifically, the control computer C commands the energization/deenergization of the electromagnetic valves $V_1$ to $V_5$ on the basis of the loom crank shaft rotational angle detection signals mentioned previously.

Figure 2:
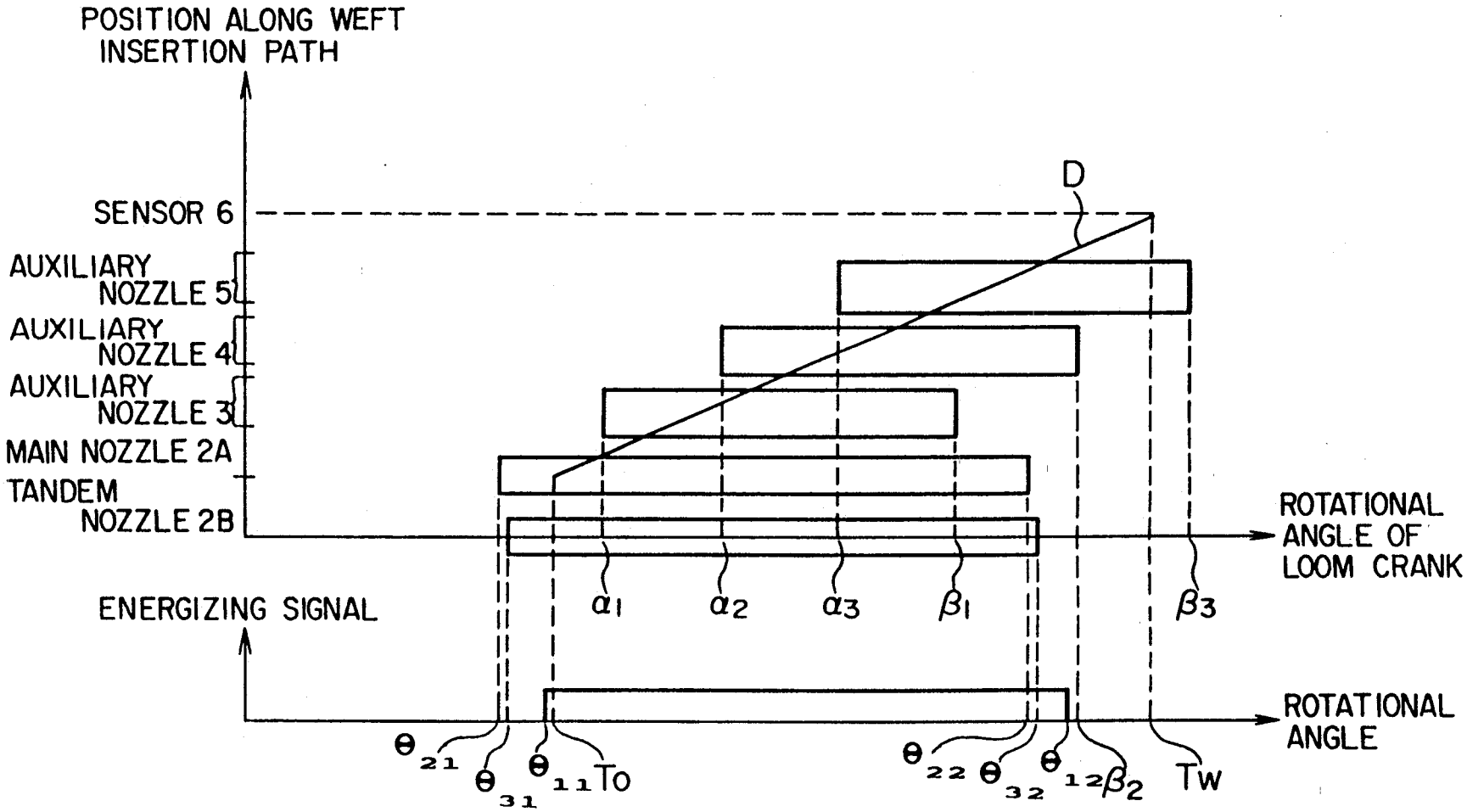
FIG. 2 is a view for graphically illustrating weft insertion control.

Referring to FIG. 2, a curve D reresents an ideal flying or running of a weft. In the figure, a loom rotational angle To represents a reference or standard weft insertion starting time point, and a loom rotational angle Tw represents a predetermined weft insertion terminal position of the leading end of the inserted weft Y, i.e. a desired time point at which the leading end of the weft as inserted has reached the position at which the weft detector 6 is installed.

A crank shaft rotational angle range $[\theta_{11}, \theta_{12}]$ represents a period during which the solenoid 7 is maintained in the energized state. A crank shaft rotational angle range $[\theta_{21}, \theta_{22}]$ represents a period during which the valve $V_1$ is energized. A loom rotational angle range $[\theta_{31}, \theta_{32}]$ represents a period during which the electromagnetic valve $V_2$ is electrically energized. Further, loom rotational angle ranges $[\alpha_i, \beta_i]$ (where i=1 to 3) represent periods during which the electromagnetic valves $V_{i+2}$ are electrically energized, respectively.

The loom rotational angle $\theta_{11}$ representing the time point for starting the electric energization of the solenoid 7, the loom rotational angle $\theta_{21}$ representing the time point for starting the air injection by the main weft inserting nozzle 2A, the loom rotational angle $\theta_{31}$ representing the time point for starting the air injection by the tandem nozzle 2B and the loom rotational angle $\beta_2$ representing the time point for stopping the air injections by the auxiliary inserting nozzles 4 can be altered or adjusted through the control of the control computer C. More specifically, on the basis of the weft insertion start time point $To_j$ which is determined by the detection output signal of the weft release detector 9 and the weft leading end arrival time point $Tw_j$ which is determined by the detection output signal of the weft leading end detector 6, the control computer C controls the weft release timing $\theta_{11}$ (given in terms of the loom rotational angle), the air injection start timing $\theta_{21}$ for the main weft inserting nozzle 2A, the air injection start timing $\theta_{31}$ of the tandem nozzle 2B and the air injection stop timing $\beta_2$ of the auxiliary inserting nozzles 4. These timings or time points $\theta_{11}$, $\theta_{21}$, $\theta_{31}$ and $\beta_2$ given in terms of the respective loom rotational angles provide basis for weft insertion state control factors or quantities which are arithmetically determined by the control computer C in accordance with control quantity (or factor) determining programs illustrated in flow charts of FIGS. 15 to 21.

Figure 3:
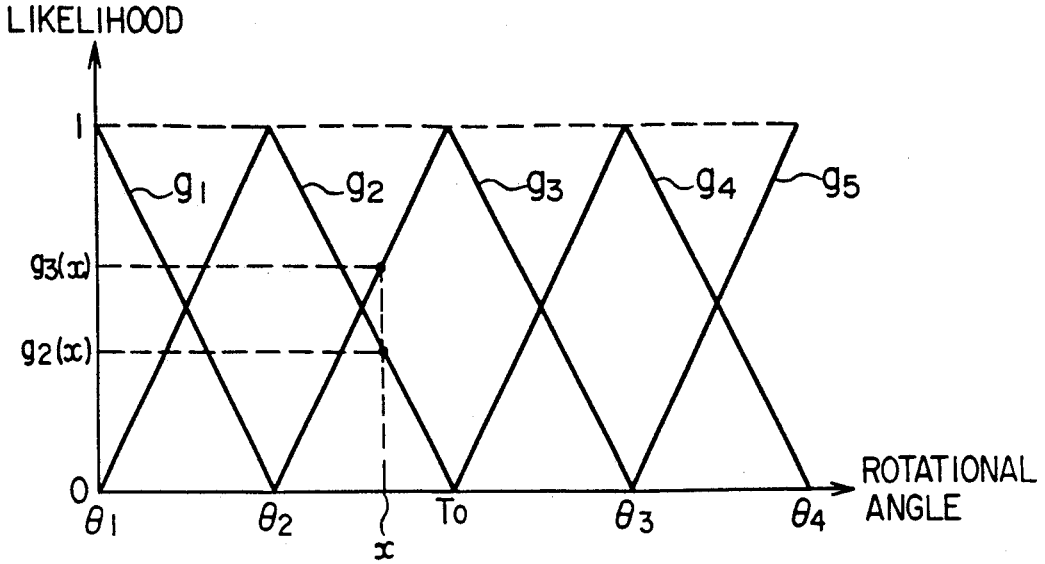
FIG. 3 is a view for graphically illustrating likelihood ratios of sequential detected data for weft insertion start timing.

Now, referring to FIG. 3, functions $g_1$, $g_2$, $g_3$, $g_4$ and $g_5$ illustrated therein are prepared in correspondence to a sequential array of weft insertion start timing data $G_1$, $G_2$, $G_3$, $G_4$ and $G_5$, respectively, which are classified in a systematic order in accordance with rules for adjusting or changing the weft insertion start timing $To_j$. In other words, the sequential array of the weft insertion start timing data $G_m$ (where m=1 to 5) are represented by a set of weft insertion start timings given in terms of loom rotational angles, as mentioned below:

$G_1$="early" weft insertion start angle (in a range of $\theta_1$ to $\theta_2$)

$G_2$="slightly early" weft insertion start angle (in a range of $\theta_1$ to To)

$G_3$="normal" weft insertion start angle (in a range of $\theta_2$ to $\theta_3$)

$G_4$="slightly late" weft insertion start angle (in a range of To to $\theta_4$)

$G_5$="later" weft insertion start angle (in a range of $\theta_3$ to $\theta_4$)

where $\theta_1<\theta_2<To<\theta_3<\theta_4$. These loom rotational angles $\theta_1$, $\theta_2$, To, $\theta_3$ and $\theta_4$ are loaded into the control computer C through an input unit 12.

The function $g_m$ (m=1 to 5) represents the weft insertion start timing as a function of likelihood ratio x of the detected data thereof.

Figure 4:
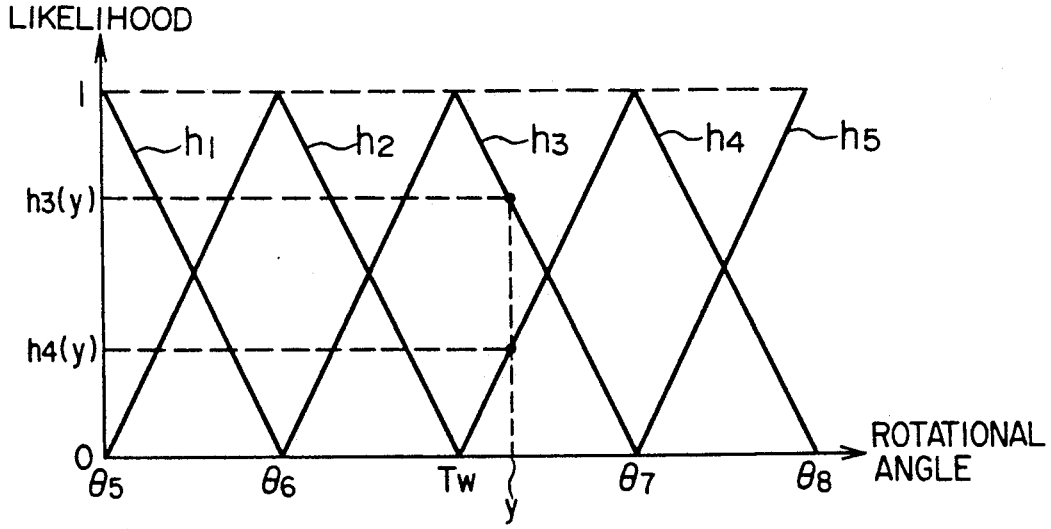
FIG. 4 is a view for graphically illustrating likelihood ratios of sequential detected data for weft leading end arrival timing.

Referring to FIG. 4, functions $h_1$, $h_2$, $h_3$, $h_4$ and $h_5$ illustrated therein are prepared in correspondence to a sequential array of weft leading end arrival timing data $H_1$, $H_2$, $H_3$, $H_4$ and $H_5$ which are classified in a systematic order in accordance with rules for adjusting or changing the weft leading end arrival timing. The sequential array of the weft leading end arrival timing data $H_n$ (where n=1 to 5) are represented by a set of the weft leading end arrival timings given in terms of loom rotational angles, as mentioned below:

$H_1$="early" weft leading end arrival timing (in a range of $\theta_5$ to $\theta_6$)

$H_2$="slightly early" weft leading end arrival timing (in a range of $\theta_5$ to Tw)

$H_3$="normal" weft leading end arrival timing (in a range of $\theta_6$ to $\theta_7$)

$H_4$="slightly late" weft leading end arrival timing (in a range of Tw to $\theta_8$)

$H_5$="later" weft leading end arrival timing (in a range of $\theta_7$ to $\theta_8$)

where $\theta_5<\theta_6<Tw<\theta_7<\theta_8$. These loom rotational angles $\theta_5$, $\theta_6$, Tw, $\theta_7$ and $\theta_8$ are inputted to the control computer C via the input unit 12.

Figure 5:
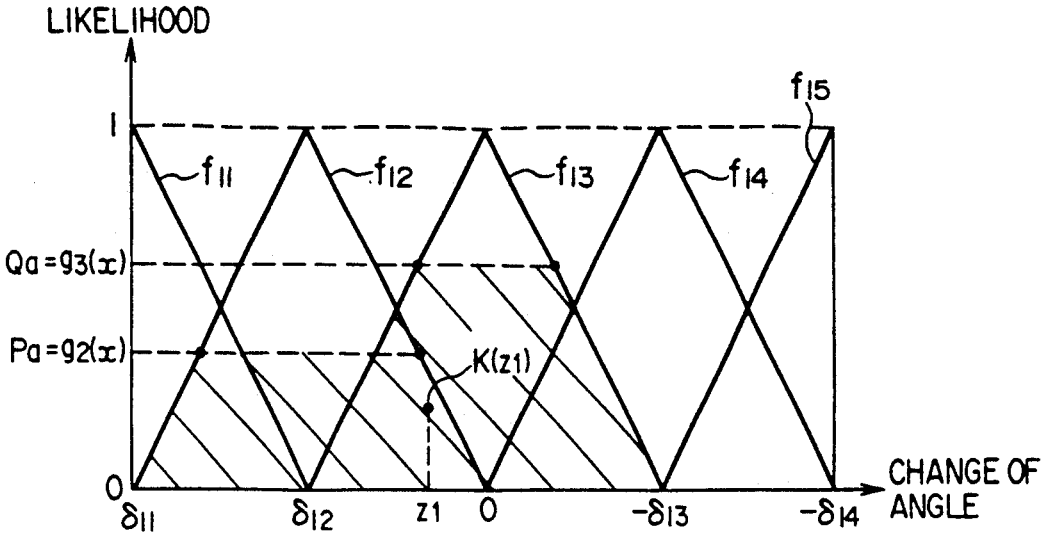
FIG. 5 is a view for graphically illustrating likelihood ratios of weft insertion state control quantities in terms of magnetic solenoid energization start timing adjustment quantities.

Next, referring to FIG. 5, functions $f_{11}$, $f_{12}$, $f_{13}$, $f_{14}$ and $f_{15}$ illustrated therein are prepared in correspondence to energization start timing adjustment data $A_1$, $A_2$, $A_3$, $A_4$ and $A_5$ for the solenoid 7 which are classified in a systematic order in accordance with rules for adjusting the energization start timing of the solenoid 7. The energization start timing adjustment data $A_a$ (where a=1 to 5) are represented by a set of loom rotational angle adjustments, as mentioned below.

$A_1$="large" positive angular adjustment (in a range of $\delta_{11}$ to $\delta_{12}$)

$A_2$="slightly large" positive angular adjustment (in a range of $\delta_{11}$ to 0)

$A_3$="normal" angular adjustment (in a range of $\delta_{12}$ to $-\delta_{13}$)

$A_4$="slightly large" negative angular adjustment (in a range of 0 to $-\delta_{14}$)

$A_5$="large" negative angular adjustment (in a range of $-\delta_{13}$ to $-\delta_{14}$)

where $-\delta_{14}<-\delta_{13}<0<\delta_{12}<\delta_{11}$

The angular adjustment data $A_a$ are utilized for controlling the weft insertion state, wherein the functions $f_{11}$, $f_{12}$, $f_{13}$, $f_{14}$, and $f_{15}$ represent the weft insertion state control quantities ($A_a$) as a function of respective likelihood ratios.

Figure 6:
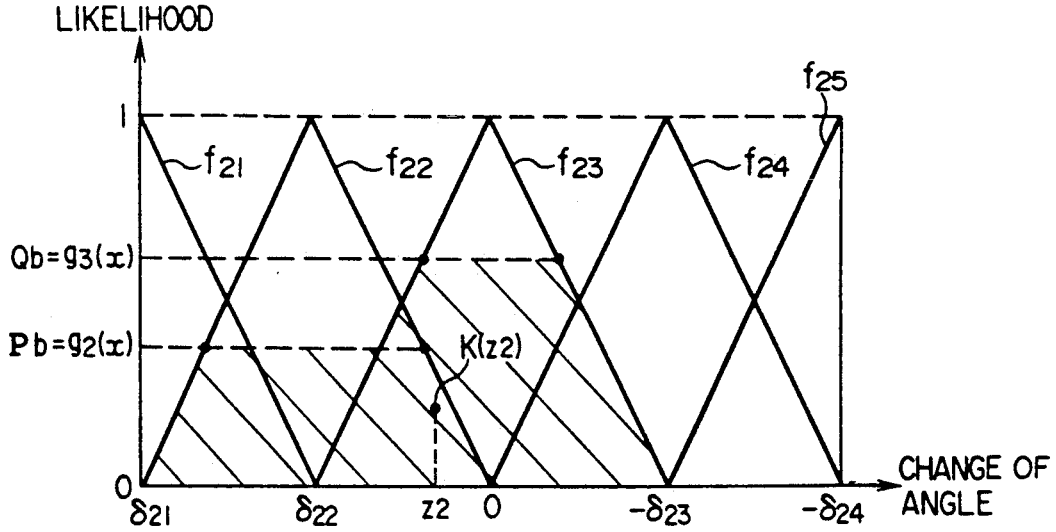
FIG. 6 is a view for graphically illustrating likelihood ratios of weft insertion state control quantities in terms of main weft inserting nozzle injection start timing adjustment quantities.

Further, functions $f_{21}$, $f_{22}$, $f_{23}$, $f_{24}$ and $f_{25}$ illustrated in FIG. 6 are prepared in correspondence to energization start timing adjustment data $B_1$, $B_2$, $B_3$, $B_4$ and $B_5$, respectively, for the electromagnetic valve $V_1$ (i.e. air injection start timings for the main weft inserting nozzle 2A), which are classified in a systematic order in accordance with rules for adjusting the air injection start timing of the electromagnetic valve $V_1$. The injection start timing adjustment data $B_b$ (b=1~5) are represented by a set of loom rotational angle adjustments, as mentioned below:

$B_1$="large" positive angular adjustment (in a range of $\delta_{21}$ to $\delta_{22}$)

$B_2$="slightly large" positive angular adjustment (in a range of $\delta_{21}$ to 0)

$B_3$="normal" angular adjustment (in a range of $\delta_{22}$ to $-\delta_{23}$)

$B_4$="slightly large" negative angular adjustment (in a range of 0 to $-\delta_{24}$)

$B_5$="large" negative angular adjustment (in a range of $-\delta_{23}$ to $-\delta_{24}$)

where $-\delta_{24}<\delta_{23}<0<\delta_{22}<\delta_{21}$

The injection start timing adjustment data $B_b$ are utilized for a control quantity or factor for controlling the weft insertion state, wherein the functions $f_{21}$, $f_{22}$, $f_{23}$, $f_{24}$, and $f_{25}$ represent the weft insertion state control quantities ($B_b$) as a function of respective likelihood ratios.

Figure 7:
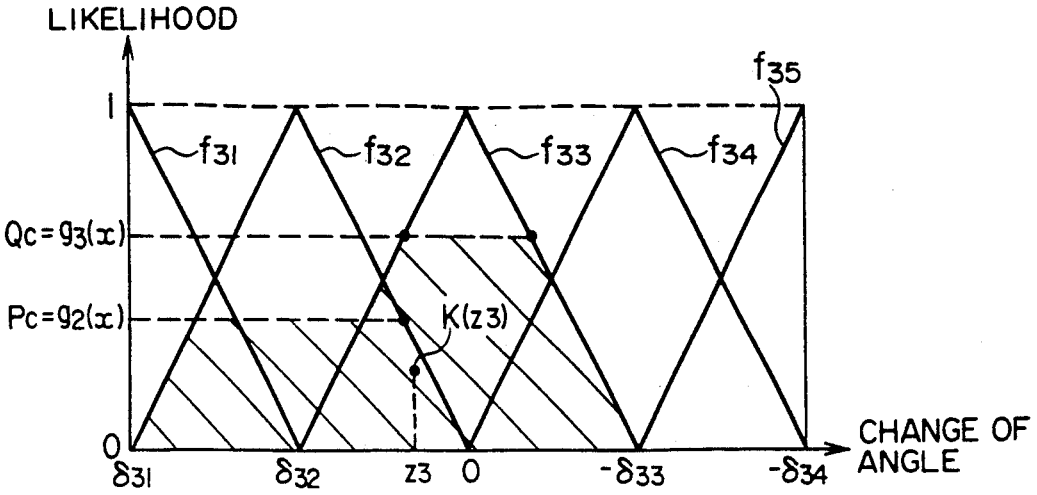
FIG. 7 is a view for graphically illustrating likelihood ratios of weft insertion state control quantities in terms of tandem nozzle injection start timing adjustment quantities.

Next, referring to FIG. 7, functions $f_{31}$, $f_{32}$, $f_{33}$, $f_{34}$ and $f_{35}$ are prepared in correspondence to injection start timing adjustment data $C_1$, $C_2$, $C_3$, $C_4$ and $C_5$, respectively, for the tandem nozzle 2B (i.e. the energization start timing adjustment data for the electromagnetic valve $V_2$), which are classified in a systematic order in accordance with rules for adjusting the air injection start timing of the tandem nozzle 2B. The air injection start timing adjustment data $C_c$ (where c=1 to 5) are represented by a set of loom rotational angle adjustments mentioned below.

$C_1$="large" positive angular adjustment (in a range of $\delta_{31}$ to $\delta_{32}$)

$C_2$="slightly large" positive angular adjustment (in a range of $\delta_{31}$ to 0)

$C_3$="normal" angular adjustment (in a range of $\delta_{32}$ to $-\delta_{33}$)

$C_4$="slightly large" negative angular adjustment (in a range of 0 to $-\delta_{34}$)

$C_5$="large" negative angular adjustment (in a range of $-\delta_{33}$ to $-\delta_{34}$)

where $-\delta_{34}<-\delta_{33}<0<\delta_{32}<\delta_{31}$

The injection start timing adjustment data $C_c$ are utilized for controlling the weft insertion state. The functions $f_{31}$, $f_{32}$, $f_{33}$, $f_{34}$, and $f_{35}$ represent the weft insertion state control quantities ($C_c$) as a function of respective likelihood ratios.

Figure 8:
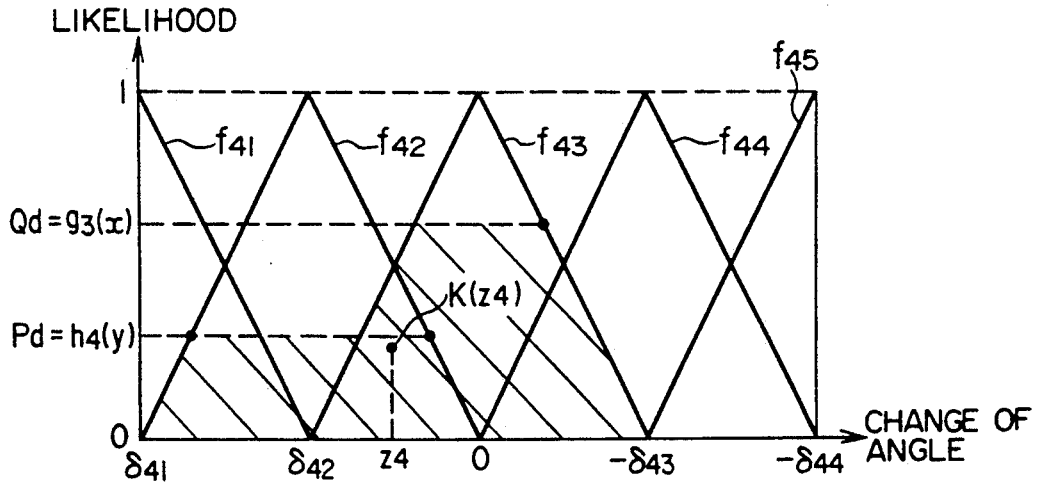
FIG. 8 is a view for graphically illustrating likelihood ratios of weft insertion state control quantities in terms of auxiliary nozzle injection stop timing adjustment quantities.

Referring to FIG. 8, functions $f_{41}$, $f_{42}$, $f_{43}$, $f_{44}$ and $f_{45}$ are prepared in correspondence to injection stop timing adjustment data $D_1$, $D_2$, $D_3$, $D_4$ and $D_5$, respectively, for the auxiliary weft inserting nozzles 4 (i.e. deenergization timing adjustment data for the electromagnetic valve $V_4$), which are classified in a systematic order in accordance with rules for adjusting or changing the air-injection stop timings of the auxiliary weft inserting nozzles 4. The injection stop timing adjustment data $D_d$ (d=1~5) are represented by a set of angular adjustments mentioned below:

$D_1$="large" positive angular adjustment (in a range of $\delta_{41}$ to $\delta_{42}$)

$D_2$="slightly large" positive angular adjustment (in a range of $\delta_{41}$ to 0)

$D_3$="normal" angular adjustment (in a range of $\delta_{42}$ to $-\delta_{43}$)

$D_4$="slightly large" negative angular adjustment (in a range of 0 to $-\delta_{44}$)

$D_5$="large" negative angular adjustment (in a range of $-\delta_{43}$ to $-\delta_{44}$)

where $-\delta_{44}<-\delta_{43}<0<\delta_{42}<\delta_{41}$

The air injection stop timing adjustment data $D_d$ are used for controlling the weft insertion state as well. The functions $f_{41}$, $f_{42}$, $f_{43}$, $f_{44}$, and $f_{45}$ represent the weft insertion state control quantities ($D_d$) as a function of respective likelihood ratios.

The sequentially arrayed detection data sets including the weft insertion start timing data set $To_j$ and the weft leading end arrival timing data set $Tw_j$ bear correspondence relations to the sequentially arrayed control quantity sets $A_a$, $B_b$, $C_c$ and $D_d$ in the light of the empirically established rules of an expert who has long experience in setting the timings for stop and release operations of the retainer pin 7a as well as the timings for the air jet injections. Further, the classification of the control quantities or factors $A_a$, $B_b$, $C_c$ and $D_d$ also depends on experiences of the expert. The correspondences between the sequential detection data arrays $G_m$ and $H_n$ on one hand and the control quantity sets $A_a$, $B_b$, $C_c$ and $D_d$ on the other hand are identified by rules $R_{m,n}$ listed in the table mentioned below, where the rules $R_{m,n}$ reflect the empirically established rules of the expert.

TABLE I

| | $H_1$ | $H_2$ | $H_3$ | $H_4$ | $H_5$ |
|---|---|---|---|---|---|
| $G_1$ | $R_{11}$ | $R_{12}$ | $R_{13}$ | $R_{14}$ | $R_{15}$ |
| $G_2$ | $R_{21}$ | $R_{22}$ | $R_{23}$ | $R_{24}$ | $R_{25}$ |
| $G_3$ | $R_{31}$ | $R_{32}$ | $R_{33}$ | $R_{34}$ | $R_{35}$ |
| $G_4$ | $R_{41}$ | $R_{42}$ | $R_{43}$ | $R_{44}$ | $R_{45}$ |
| $G_5$ | $R_{51}$ | $R_{52}$ | $R_{53}$ | $R_{54}$ | $R_{55}$ |

Figure 15:
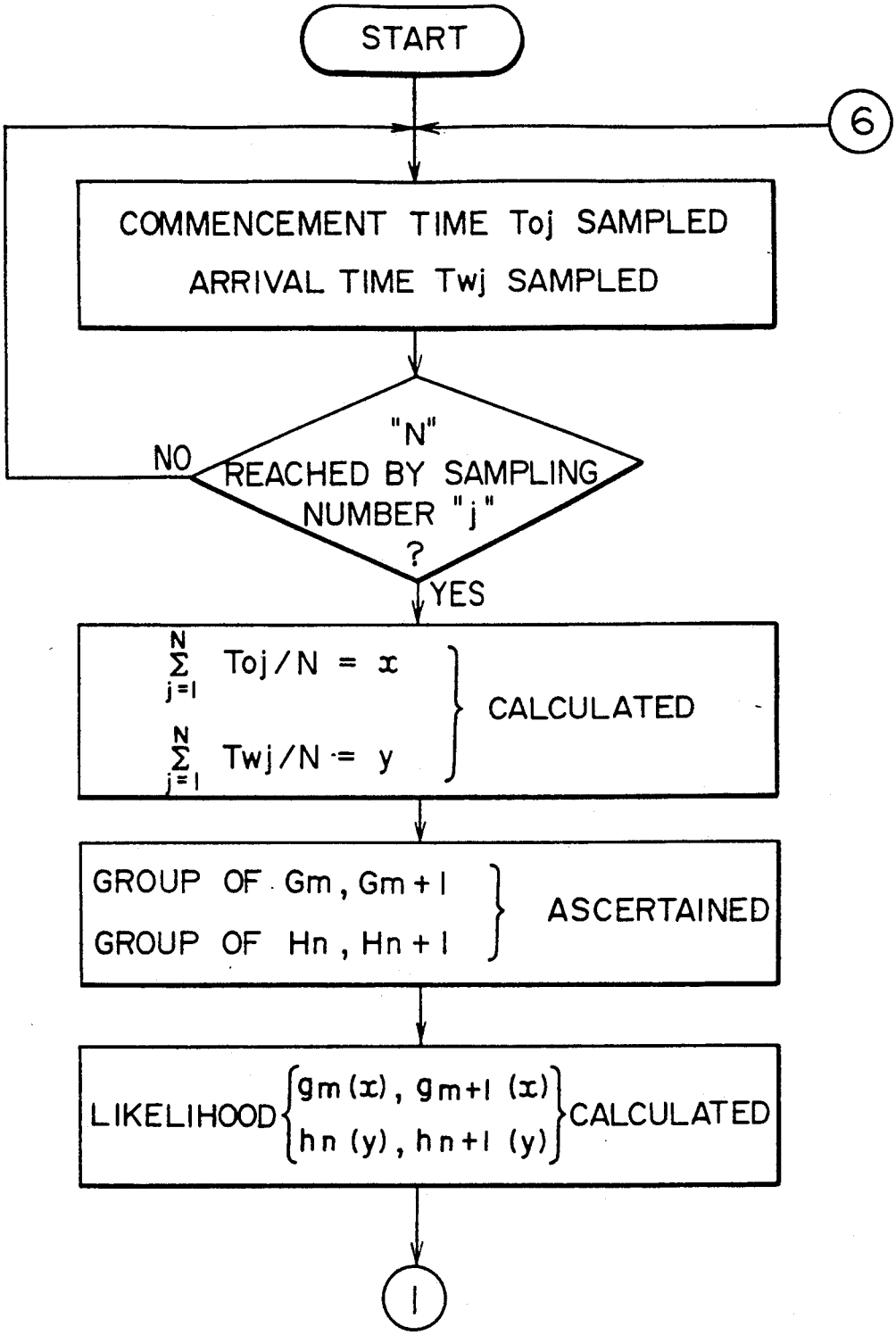
FIGS. 15 to 21 are flow charts for illustrating control quantity determining procedures.
Figure 16:
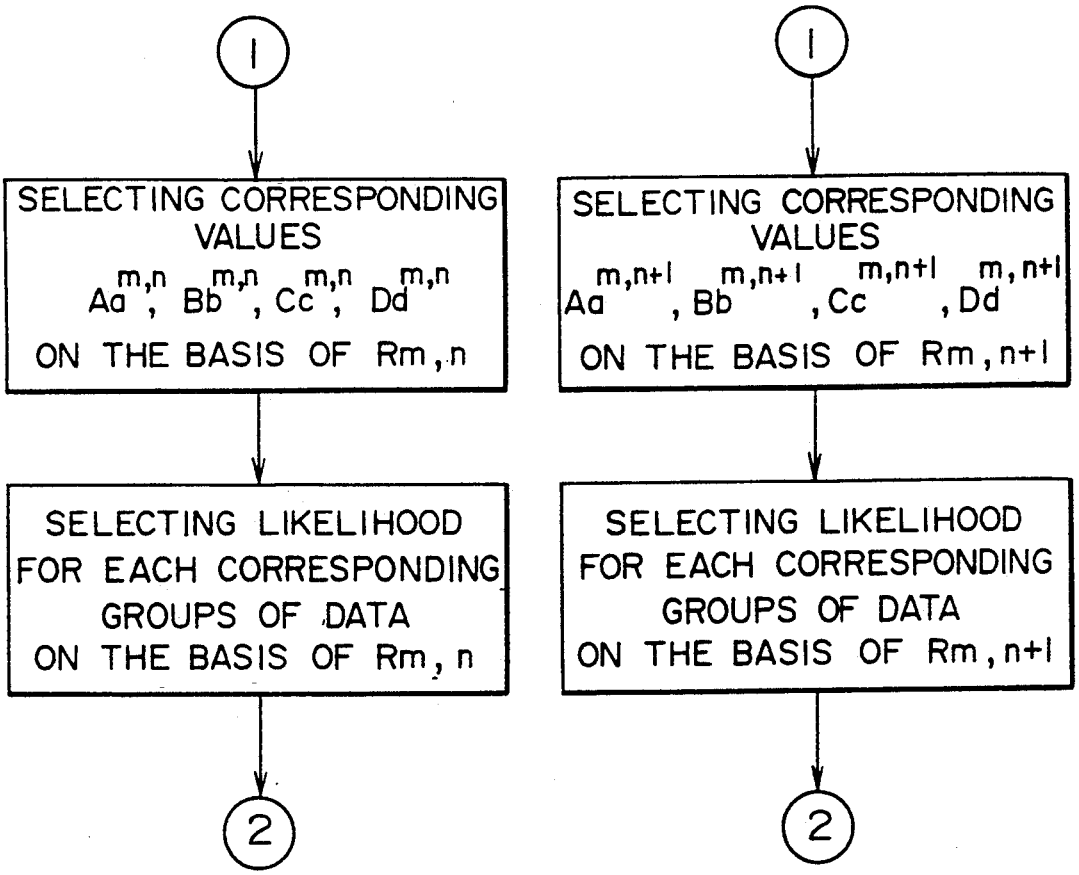
Figure 17:
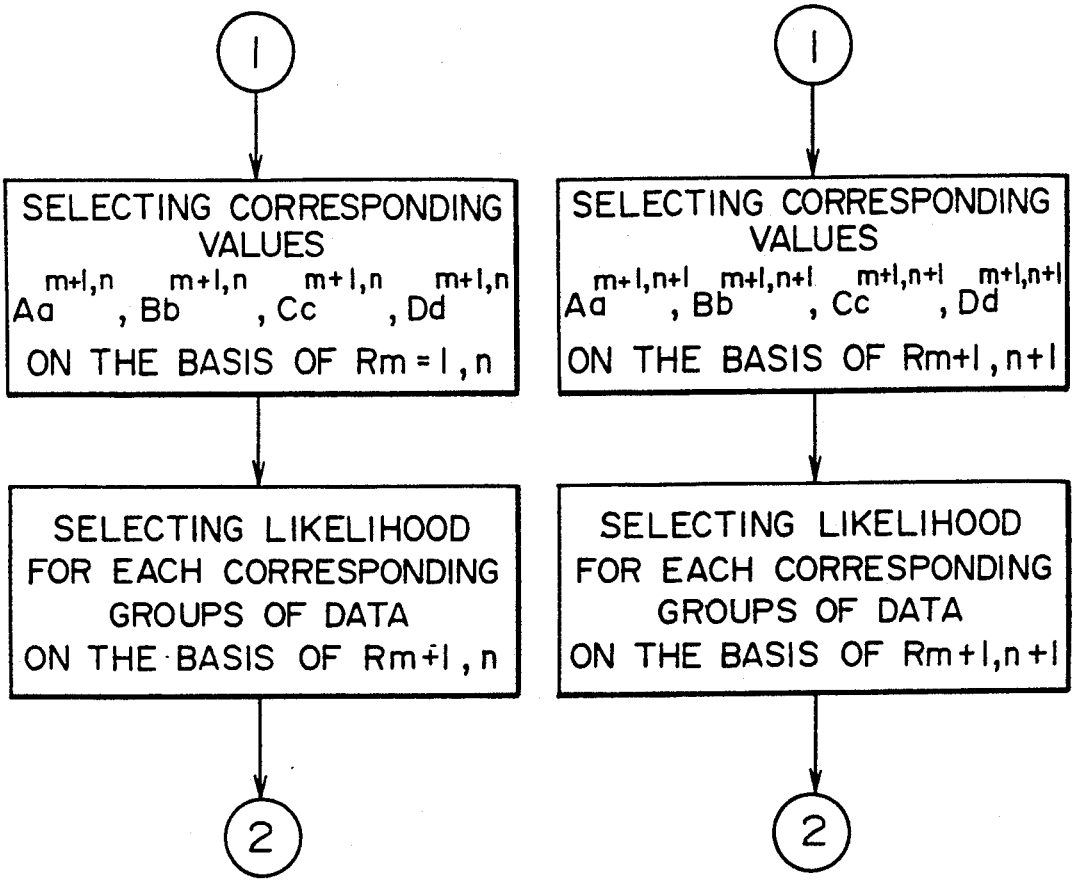
Figure 18:
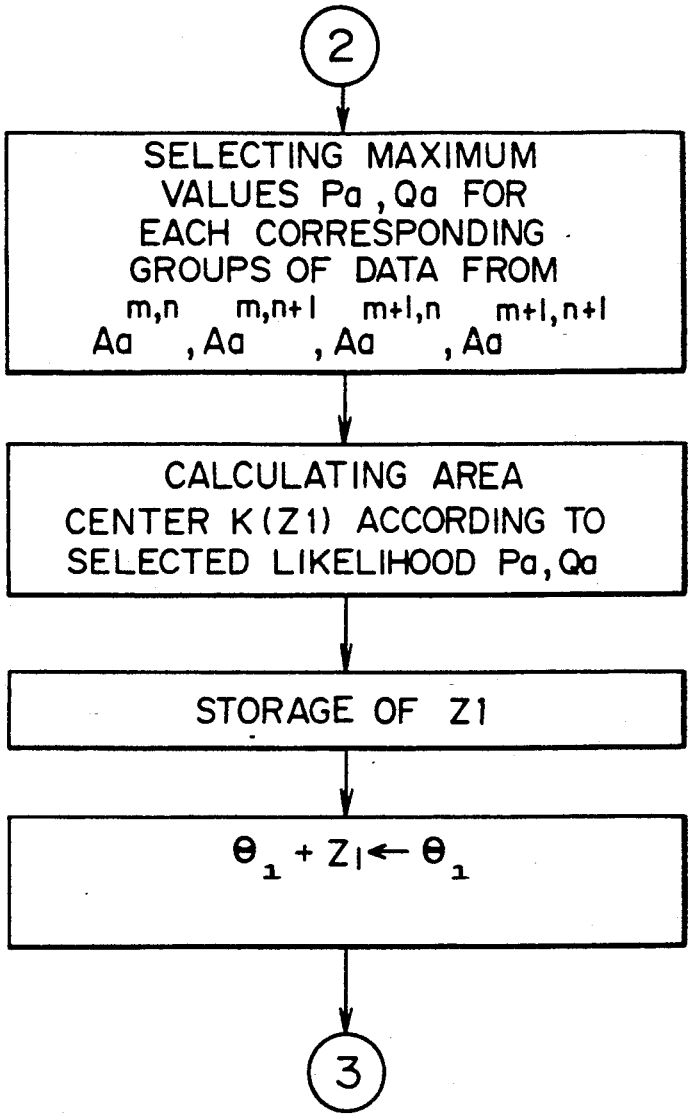
Figure 19:
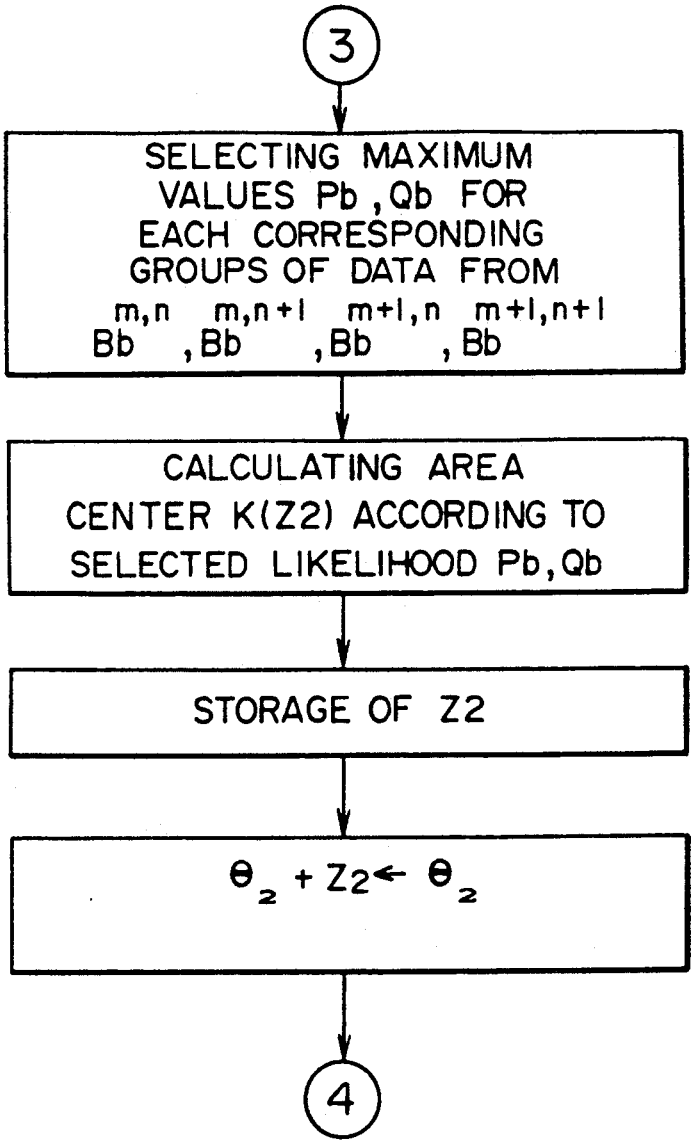
Figure 20:
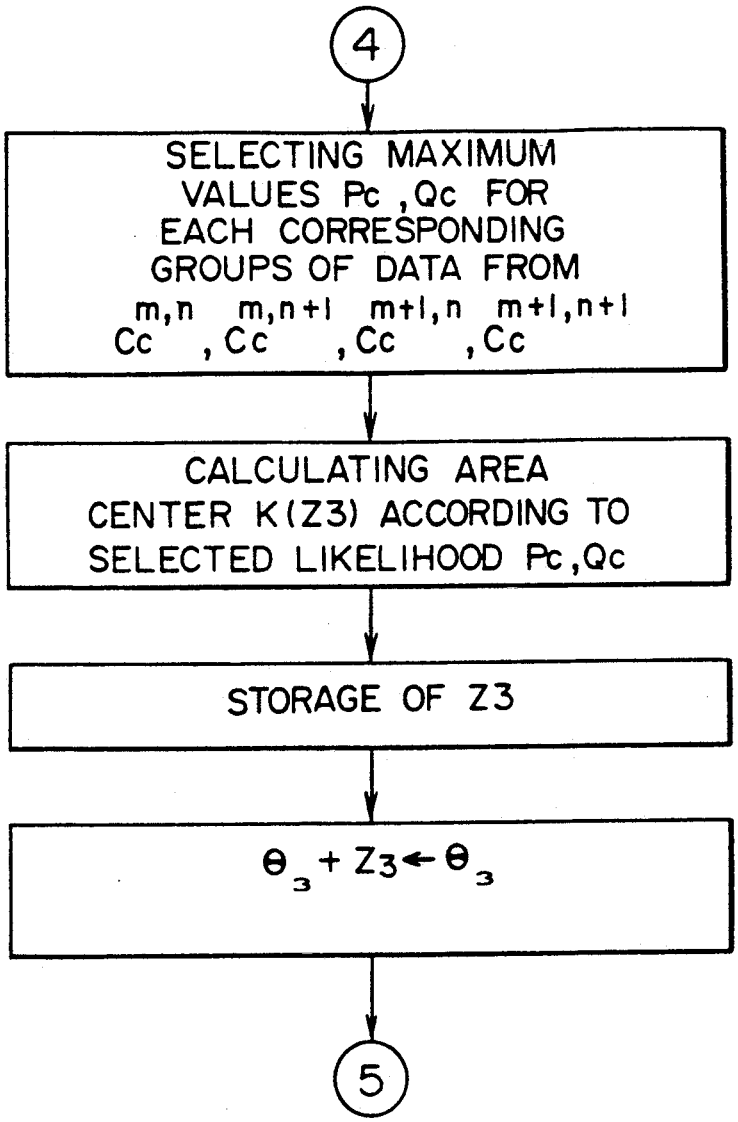
Figure 21:
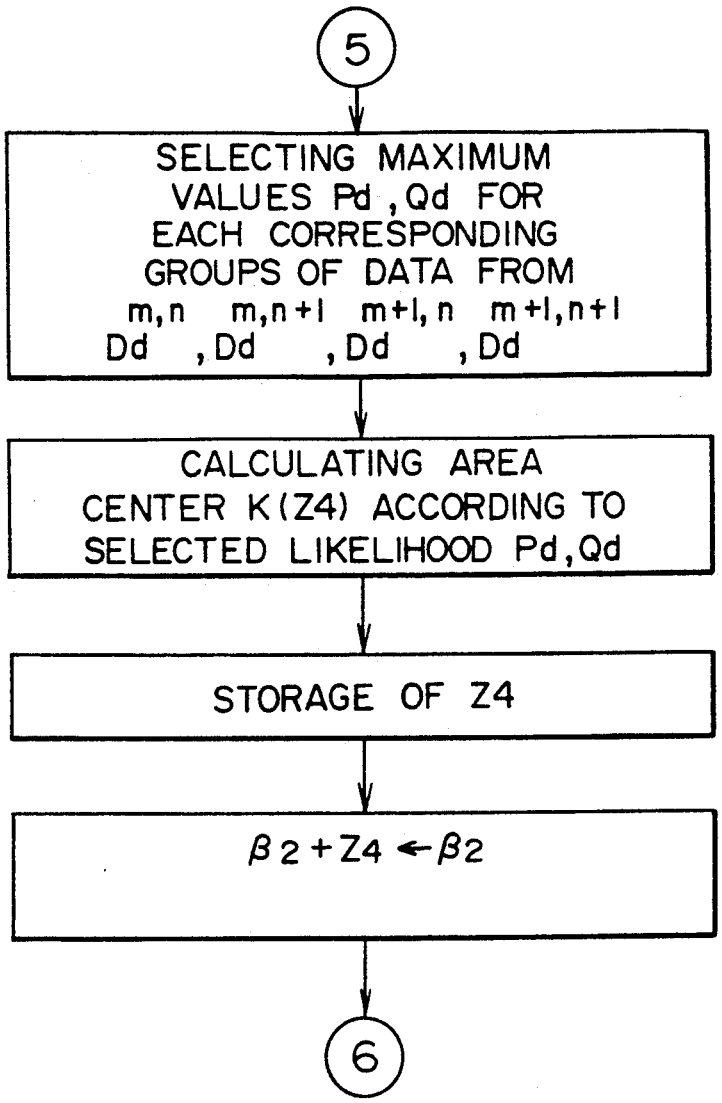

The control computer C executes the control quantity (or factor) determining programs shown in flow charts of FIGS. 15 to 21 by using the detection data obtained from the outputs of the weft detector 6 and the weft release detector 9 as well as the rules $R_{m,n}$. More specifically, as indicated in FIGS. 1 and 15, the control computer C includes sampling means which samples a predetermined number N of times the weft insertion start timing $To_j$ derived from the output of the weft release detector 9 as well as the weft leading end arrival timing $Tw_j$ obtained from the output of the weft detector 6 and subsequently determines arithmetically mean values x and y for these timing data, respectively, for every predetermined number (N) of the samplings. Next, the control computer C selects the weft insertion start timing data set $G_m$ to which the calculated weft insertion timing value x belongs and the weft leading end arrival timing data set $H_n$ to which the calculated weft leading end arrival timing value y belongs, whereon the control computer C calculates the likelihood ratio values $g_m$ (x), $g_{m+1}$ (x); $h_{n+1}$ (y) in accordance with the functions $g_m$ and $g_{m+1}$ corresponding to the selected weft insertion start timing data sets $G_m$ and $G_{m+1}$ and the functions $h_n$ and $h_{n+1}$ corresponding to the selected weft leading end arrival timing sets $H_n$ and $H_{n+1}$. In the case of the example illustrated in FIGS. 3 and 4, the weft insertion start timing x as calculated belongs to the sets $G_2$ and $G_3$ while the calculated weft leading end arrival timing y belongs to the sets $H_3$ and $H_4$. The likelihood ratios of the value x in the sets $G_2$ and $G_3$ are given by $g_2$ (x) and $g_3$ (x), while the likelihood ratios of y in the sets $H_3$ and $H_4$ are given by $h_3$ (y) and $h_4$ (y), respectively.

Next, the control computer C, which includes control quantity determining means selects by consulting the table I the rules corresponding to the sets $G_2$ and $G_3$ to which x belongs and the rules corresponding to the sets $H_3$ and $H_4$ to which y belongs, respectively. The rules thus selected are $R_{23}$, $R_{24}$, $R_{33}$ and $R_{34}$ in the case of the illustrated example. These rules $R_{23}$, $R_{24}$, $R_{33}$ and $R_{34}$ read, for example, as follows:

$R_{23}$ : select control quantities $A_2$, $B_2$, $C_2$ and $D_3$
$R_{24}$ : select control quantities $A_3$, $B_3$, $C_3$ and $D_2$
$R_{33}$ : select control quantities $A_3$, $B_3$, $C_3$ and $D_3$
$R_{34}$ : select control quantities $A_3$, $B_3$, $C_3$ and $D_2$ It should be noted that the likelihood ratio is selected to be a maximum value for each of the rules $R_{m,n}$.

Thus, the adjustment or change quantity for the energization start timing of the solenoid 7 is included in the control quantity ranges $A_2$ and $A_3$, wherein the likelihood ratios Pa and Qa are given by $g_2$ (x) and $g_3$ (x), respectively, as is illustrated in FIG. 5. The adjustment or change quantity for the injection start timing of the main weft inserting nozzle 2A is included in the control quantity ranges $B_2$ and $B_3$, wherein the likelihood ratios Pb and Qb are given by $g_2$ (x) and $g_3$ (x), respectively, as can be seen in FIG. 6.

The adjustment or change quantity for the injection start timing of the tandem nozzle 2B is included in the control quantity ranges $C_2$ and $C_3$, wherein the likelihood ratios Pc and Qc are given by $g_2$ (x) and $g_3$ (x), respectively, as shown in FIG. 7. Finally, the adjustment or change quantity for the air jet injection stop timing of the auxiliary nozzles 4 is included in the control quantity ranges $D_2$ and $D_3$, wherein the likelihood ratios Pd and Qd are given by $h_4$ (y) and $g_3$ (x), respectively, as can be seen in FIG. 8.

On the basis of the control quantity ranges $A_2$ and $A_3$ as well as the likelihood ratio values $g_2$ (x) and $g_3$ (x) thus selected, the control computer C arithmetically determines the centroid $K(z_1)$ of a hatched area shown in FIG. 5. Subsequently, the control computer C sets as the adjustment or change quantity of the weft insertion start timing the loom rotational angle adjustment quantity $z_1$ which corresponds to the calculated centroid $K(z_1)$, as a result of which the weft insertion start timing $\theta_1$ adopted until then is changed to $\theta_1 + z_1$.

Through similar procedures, the jet injection start timing adjustment quantity $z_2$ for the main weft inserting nozzle 2A, the jet injection start timing adjustment quantity $z_3$ for the tandem nozzle 2B and the jet injection stop timing adjustment quantity $z_4$ for the auxiliary weft inserting nozzles 4 are arithmetically determined on the basis of combinations of the control quantity sets and the likelihood ratios [$B_2$, $B_3$; $g_2$ (x), $g_3$ (x)], [$C_2$, $C_3$; $g_2$ (x), $g_3$ (x)] and [$D_2$, $D_3$; $h_4$ (y), $g_3$ (x)], respectively. The detected weft insertion start timing x shown in FIG. 9 occurs earlier than that shown in FIG. 3, while the detected weft leading end arrival timing y shown in FIG. 10 occurs earlier than that shown in FIG. 4. The adjustment quantities $z_1$, $z_2$, $z_3$ and $z_4$ derived from the detected data shown in FIGS. 9 and 10 differ distinctly from those shown in FIGS. 5 to 8, as can be seen from FIGS. 11 to 14. It will thus be appreciated that even when the detected data x and y vary only a little, the adjustment quantities $z_1$, $z_2$, $z_3$ and $z_4$ for the weft insertion control assume significantly different values, whereby the fine weft insertion control can be achieved.

Figure 9:
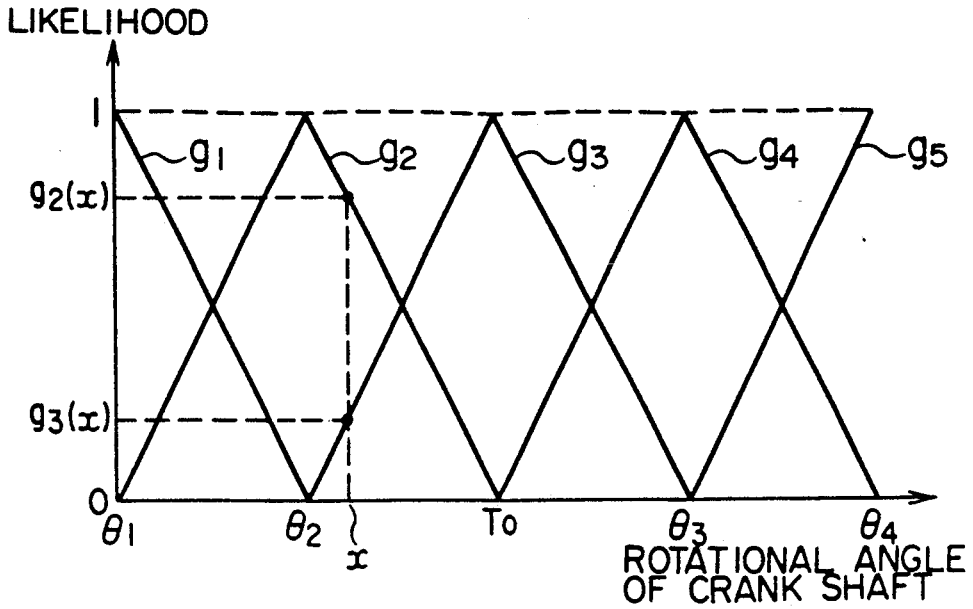
FIG. 9 is a view for graphically illustrating likelihood ratios of sequential detected data for weft insertion start timing.
Figure 10:
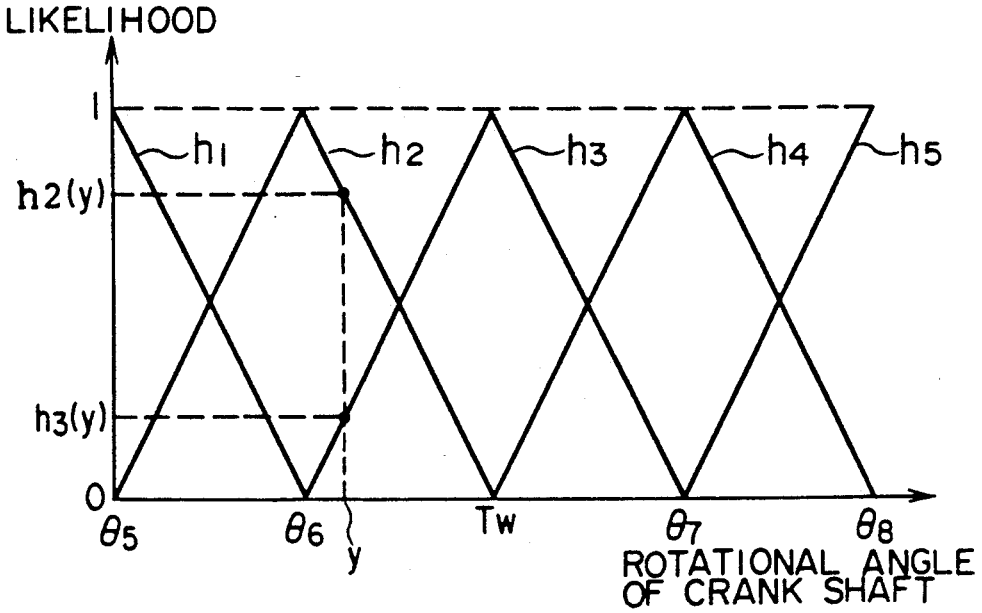
FIG. 10 is a view for graphically illustrating likelihood ratios of sequential detected data for weft leading end arrival timing.
Figure 11:
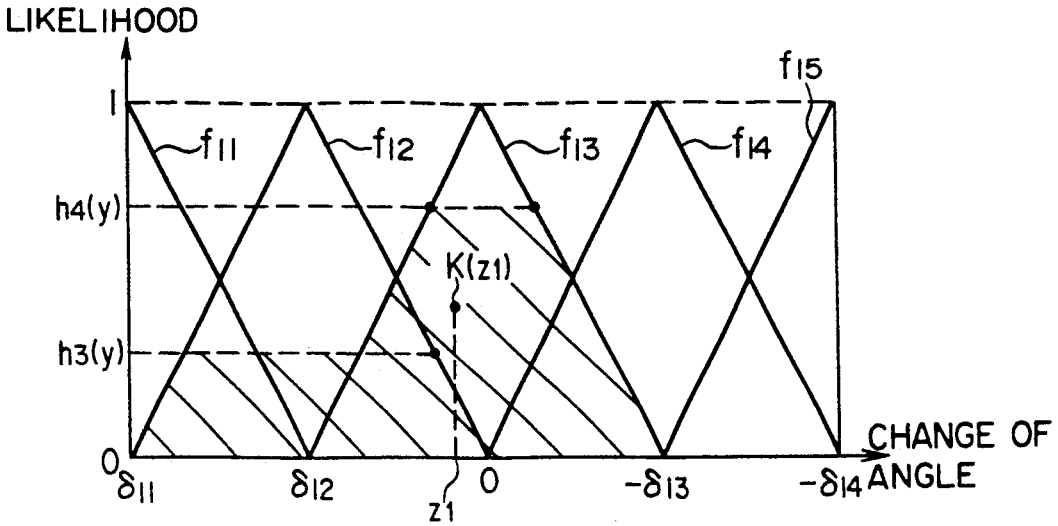
FIG. 11 is a view for illustrating graphically likelihood ratios of sequential weft insertion state control quantities in terms of magnetic solenoid energization start timing adjustment quantities.
Figure 12:
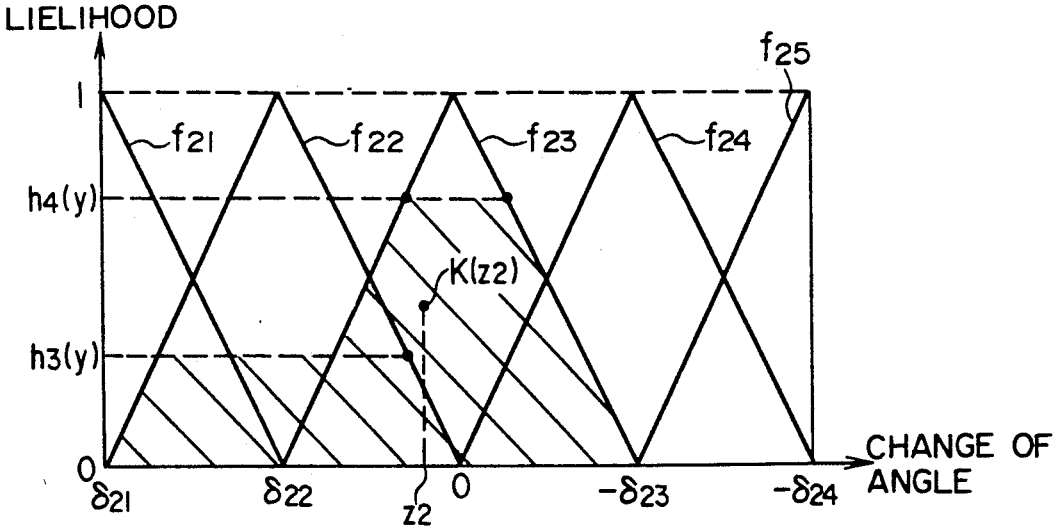
FIG. 12 is a view for illustrating graphically likelihood ratios of sequential weft insertion state control quantities in terms of main weft inserting nozzle injection start timing adjustment quantities.
Figure 13:
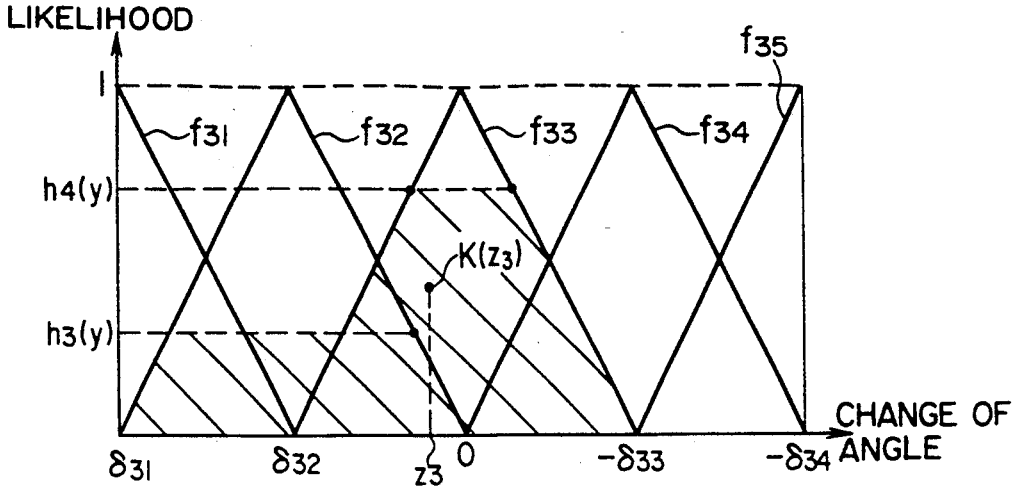
FIG. 13 is a view for illustrating graphically likelihood ratios of sequential weft insertion state control quantities in terms of tandem nozzle injection start timing adjustment quantities.
Figure 14:
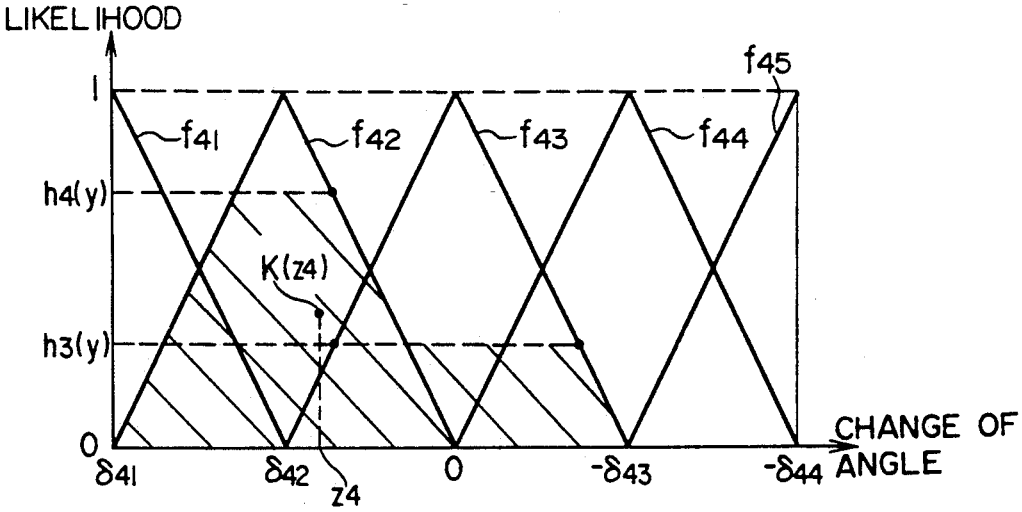
FIG. 14 is a view for illustrating graphically likelihood ratios of sequential weft insertion state control quantities in terms of auxiliary nozzle injection stop timing adjustment quantities.

The weft insertion state represented by the detected data x and y shown in FIGS. 3 and 4 tends to be identical with the weft insertion state represented by the detected data x and y shown in FIGS. 9 and 10. For this reason, it can be said that the weft insertion control system disclosed in Japanese Unexamined Patent Application Publication No. 117853/1987 (JP-A-62-117853) exhibits substantially no significant difference in the degree of control and will thus encounter difficulty in realizing the appropriate weft insertion control. In contrast, the weft insertion control according to the illustrated embodiment of the invention can effectuate a very fine weft insertion control in correspondence to differences in the value of the detected data x and y, and thus the satisfactory weft insertion control can be realized by establishing appropriately the rules $R_{m,n}$.

As previously mentioned, the rules $R_{m,n}$ are prepared in the light of the empirically established rules or experience of the expert which are generally very pertinent. Thus, the rules $R_{m,n}$ can be prepared by the expert without difficulty, rendering it unnecessary to resort to very time-consuming work of experimentally determining the energization start timing of the solenoid 7, the jet injection start timings of the nozzles 2A and 2B and the jet injection stop timing of the auxiliary nozzles 4. In particular, the procedure for experimentally specifying the four output data $z_1$, $z_2$, $z_3$ and $z_4$ on the basis of two detected data x and y is impractical as a matter of fact because of a very large number of possible combinations. In contrast, by virtue of the teaching of the invention incarnated in the illustrated embodiment, the four output data $z_1$, $z_2$, $z_3$ and $z_4$ can easily be specified for the two input data x and y simply by relying on the empirical rules or experiences of the expert.

It should be appreciated that the present invention is never limited to the embodiment described above but many modifications are possible without departing from the spirit and scope of the invention. By way of example, the invention can equally be applied to such system in which adjustment control is performed on only one of energization start timing of the solenoid 7, the jet injection start timing of the main weft inserting nozzle 2A, the jet injection start timing of the tandem nozzle 2B and the jet injection stop timing of the auxiliary nozzles 4.

Although the foregoing description is directed to the weft insertion control to be carried out in the course of the loom operation, it should be understood that the teaching of the invention can be applied to selective setting of the control quantities for the weft insertion controller upon initialization thereof in precedence to the start of loom operation. More specifically, instead of inputting as the weft insertion control data those derived from the outputs of the various detectors described hereinbefore in conjunction with the illustrated embodiment, only relevant data can manually be inputted by operator, whereon the control quantities for the weft insertion controller can automatically be set selectively through the similar procedure as described above. After the loom is put into operation with these initially set control quantities, data of the weft insertion start timing and the weft leading end arrival timing as derived from the relevant detectors are inputted to the control computer, to thereby allow the timings for the various weft insertion control devices of concern to be adjusted or corrected in accordance with the commands issued by the control computer.

Furthermore, although it has been described that the weft insertion start timing and the weft leading end arrival timing are used as the input data supplied to the data input means in the case of the illustrated embodiment, it should be noted that additional data such as type of the weft, thickness thereof, width of fabric to be woven, diameter of a weft length measuring drum and others may be inputted manually by operator, whereon a plurality of sequentially arrayed data sets may correspondingly be prepared by classifying or categorizing the input data in a systematic order in accordance with relevant sequencing rules. Also, the invention may be applied to the control of a pressure of fluid discharged through each of the valves $V_1$ to $V_5$.

It should additionally be pointed out that the present invention may be so modified as to employ, in addition to the jet injection start/stop timings of the main weft inserting nozzle, the tandem nozzle and the auxiliary nozzles, the start/stop timings of the solenoid for the weft length measuring/reserving device, an electromagnetic cutter for cutting the weft and the like devices as additional control quantities or factors.

Figure 22:
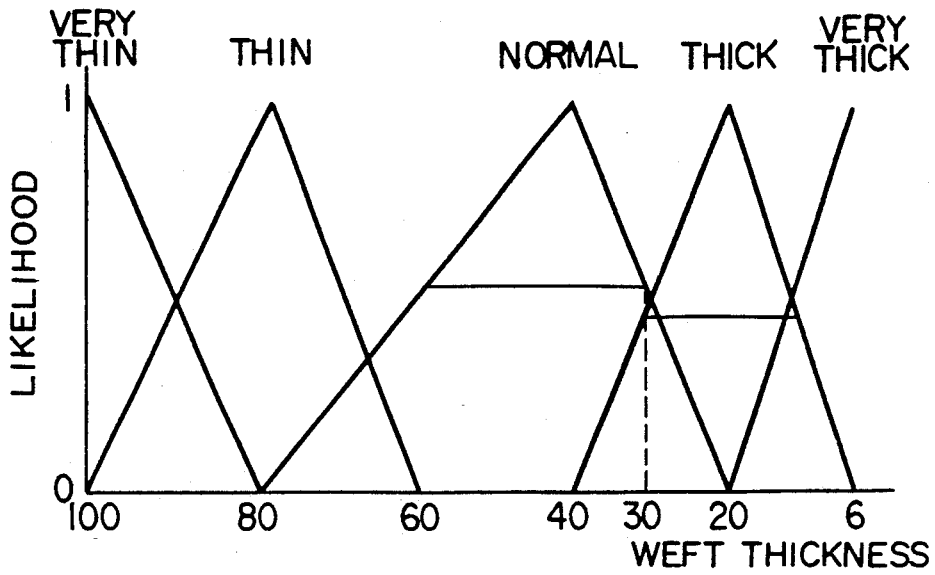
FIG. 22 is a view for graphically illustrating a function of weft thickness typically for cotton yarn.
Figure 23:
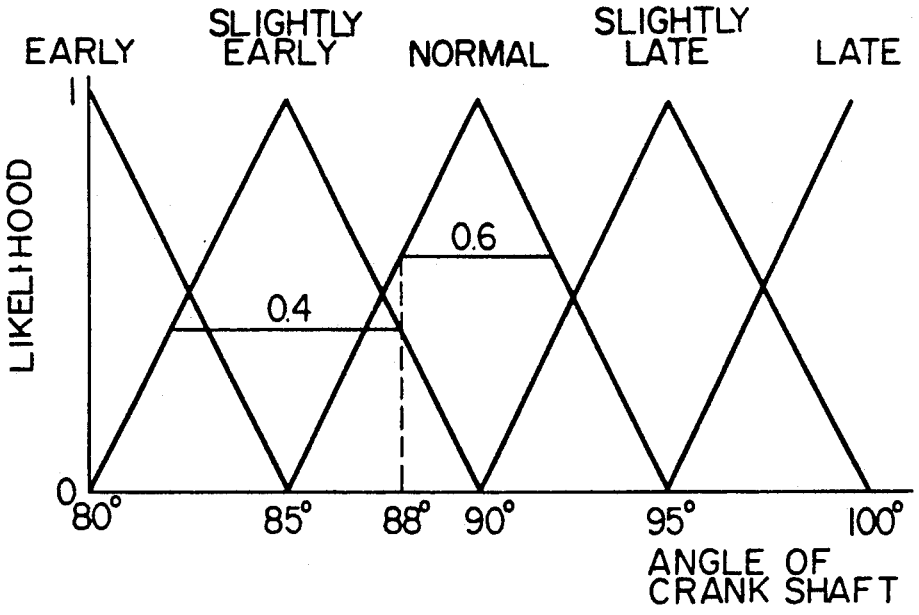
FIG. 23 is a view for graphically illustrating a function for desired weft insertion start timing.
Figure 24:
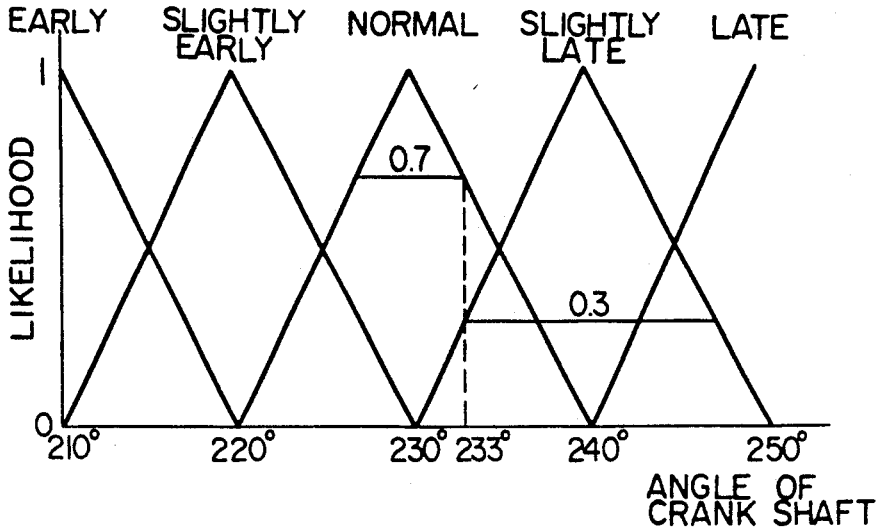
FIG. 24 is a view for graphically illustrating a function for desired weft leading end arrival timing.

This modification will be described below by reference to FIGS. 22 to 26. The types of weft are classified into spun type and filament type, whereon specific functions of weft thickness, weft insertion start timing To and the weft leading end arrival timing Tw are prepared for each of the weft types upon initialization, as is illustrated in FIGS. 22, 23 and 24. For the preparation of these functions, the sequentially arrayed data sets or rules are so established as to be "very thin", "thin", "normal", "thick" and "very thick" for the thickness of yarn and "early", "slightly early", "normal", "slightly late" and "late" for both the weft insertion start timing To and the weft leading end arrival timing Tw, as in the case of the preceding embodiment.

On the basis of the initialized values of the weft thickness (count of yarn), weft insertion start timing To and weft leading end arrival timing Tw, rules are created for determing ON/OFF timings of a weft cutter 20 (see FIG. 1) and others by consulting the expert's empirical rules. By way of example, in the case of cotton yarn, rules may read as follows:

Rule 1: If yarn thickness is "normal" with To and Tw being both "normal", then the cutter ON timing is set to be "normal" with cutter OFF timing being "normal".

Rule 2: If yarn is "thick" with To being "slightly "early" and Tw being "normal", then the cutter ON timing is set to be "early" with cutter OFF timing being "normal".

These rules are also prepared not only for the spun type weft but also for the filament type in conjunction with the ON (cutter operation start) and OFF (cutter operation stop) timings of the electro-magnetic devices provided in association with the main weft inserting nozzle, the auxiliary weft inserting nozzles, the tandem nozzle and the retainer pin of the weft length measuring-/reserving device. Since the number of the sequencing rules are five for each of the weft thickness, the weft insertion start timing and the weft leading end arrival timing, there are prepared 125 rules for each type of the weft. The sequencing rules for the relevant electromagnetic devices are same as those described in conjunction with the preceding embodiment.

Now, referring to FIGS. 22 to 24 and assuming that the initialized values of the weft thickness, the weft insertion start timing To and the weft leading end arrival timing Tw are "30°", "88°" and "233°", respectively, the likelihood ratios or function values for the weft thickness of "30" can be determined to be "0.6" and "0.5" for the classes "normal" and "thick", respectively, in accordance with the weft thickness functions shown in FIG. 22. Similarly, the function values for the weft insertion start timing To are "0.4" and "0.6" for "slightly early" and "normal", respectively, as can be seen from FIG. 23, while the function values for the weft leading end arrival timing Tw are "0.7" and "0.3" for "normal" and "slightly late", respectively, as can be seen from FIG. 24. By fitting these values in the aforementioned rules, there can be estimated the ON/OFF timings for the weft cutter and others. In that case, smaller values taken along the Y-axes of the functions for the initialized values of the weft thickness, the weft insertion start timing and the weft leading end arrival timing are set as Y-axis values of the functions for the "ON"/"OFF" timings when there are available a plurality of conclusions, greater Y-axis values of the relevant functions are employed.

More specifically, when the rules mentioned hereinbefore are applied to extract smaller Y-axis values, Rule 1:

Cutter "ON" timing "normal" min [0.6, 0.6, 0.7]=0.6

Cutter "OFF" timing "normal" min [0.6, 0.6, 0.7]=0.6

Rule 2:

Cutter "ON" timing "early" min [0.5, 0.4, 0.7]=0.4

Cutter "OFF" timing "early" min [0.5, 0.4, 0.7]=0.4

Figure 25:
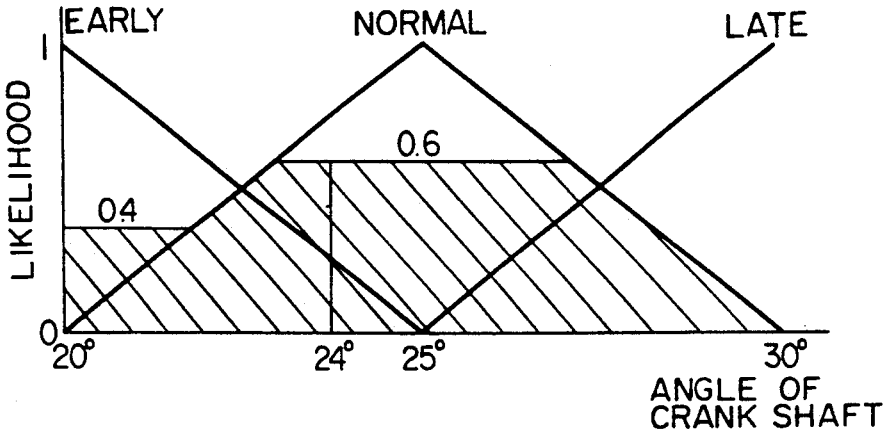
FIG. 25 is a view for graphically illustrating a function for "ON" timing of a weft cutter in case a cotton weft is employed.
Figure 26:
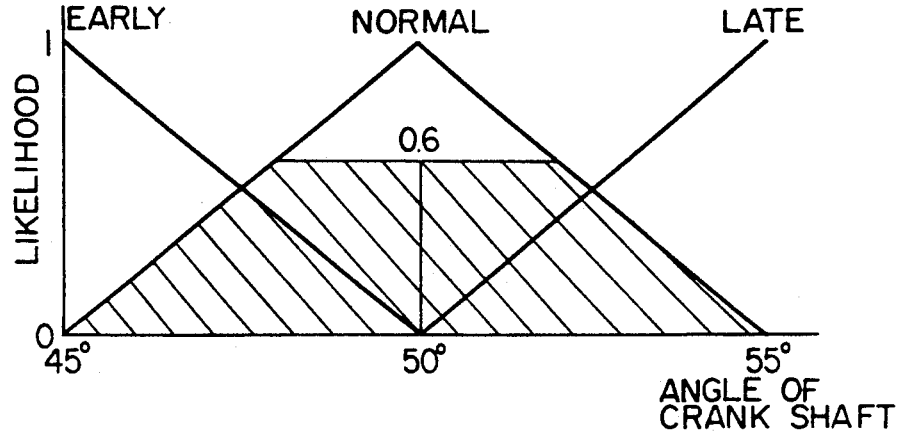
FIG. 26 is a view for graphically illustrating a function for "OFF" timing of a weft cutter in case a cotton weft is employed.

Accordingly when the values of the functions for To and Tw having greater likelihood ratios are selected, then it will be seen from FIGS. 25 and 26 that Cutter "ON" timing "normal": 0.6

Cutter "ON" timing "early": 0.4

Cutter "OFF" timing "normal": max [0.6, 0.4]=0.6 Accordingly, the centroids of the hatched areas shown in FIGS. 25 and 26 are then determined as described hereinbefore in conjunction with the first embodiment, which is followed by determination of values on the X-axis at which the perpendiculars from the centroids intersect the X-axis. Now, there can be determined "24°" and "50°" as the initialization values for the cutter "ON" and "OFF" timings, respectively. After the loom operation has been started, these initialization values of "ON"/"OFF" timings are updated by using the weft insertion start timing data and the weft leading end arrival timing data obtained from the outputs of the respective detectors and by applying the rules prepared by the expert through the procedure described hereinbefore.

As will now be appreciated from the foregoing description, according to the teachings of the invention that the control quantities are selected for the detected data on the basis of specific empirical-rule-based correspondence relations between the sequential array of data composed of a plurality of weft insertion start timing data classified in accordance with relevant sequencing rules and plurality of weft leading end arrival timing data classified in accordance with relevant sequencing rules on one hand and a plurality of sequentially arrayed control quantities classified in accordance with weft insertion state control quantity sequencing rules on the other hand, it is possible to select definitely and appropriately the pertinent control quantity from the control quantity set classified in the light of empirically established rules of an expert, whereby the pertinent weft insertion state control quantity can be determined rather straightforwardly without resorting to extremely troublesome work involved in determining the control quantity on the basis of data obtained experimentally.

The presently disclosed embodiments are to be considered in all respects as illustrative and not restrictive, the scope of the invention being indicated by the appended claims, rather than the foregoing description. It is to be understood that numerous modifications to the disclosed embodiments are possible without departing from the spirit and scope of the appended claims and it is intended that all such modifications be covered by such claims.

I claim:

1. Apparatus for controlling weft insertion in a jet loom, comprising:

data input means for inputting: a first group of sequential arrayed data resulting from orderly classification of data for at least weft insertion start timing and weft leading end arrival timing in accordance with a first sequencing rule, and a second group consisting of sequential control elements resulting from orderly classification of control elements relating to control quantities for weft insertion devices including a weft cutter in accordance with a second sequencing rule;

control quantity determining means for (a) determining specific data for said weft insertion start timing and said weft leading end arrival timing in said first group as well as likelihood values of said data on the basis of values predetermined for said weft insertion start timing and said weft leading end arrival timing, (b) selecting from said second group those of said control elements which bear specific correspondence relations to said determined specific data, and (c) determining for said weft insertion devices control quantities including operation start and stop timings of said weft insertion devices and weft cut timing for said weft cutter on the basis of said likelihood selected control elements and said determined likelihood values; and means for utilizing said control quantities to effect control of said weft insertion devices and weft cutter.

2. Apparatus for controlling weft insertion according to claim 1, wherein said first group of arrayed data includes data of type and thickness of the weft.

3. Apparatus for controlling weft insertion according to claim 1, wherein means are provided for setting the timing of said selection of the weft insertion control elements for the control quantities for said input data by said control quantity determining means upon initialization of said weft insertion control apparatus prior to start of operation of said jet loom.

4. In a jet loom in which a weft, released from weft retaining action exerted by weft release control means operable between a state in which said weft is allowed to be withdrawn from a weft storing means and a state in which said weft is prevented from being withdrawn from said weft storing means, is inserted in a given direction into a warp shed under action of an air jet injected by a main inserting nozzle, apparatus for controlling the insertion of the weft comprising:

weft insertion start timing detecting means including a weft release detector disposed in association with said weft release control means for detecting releasing of the weft from the state retained by said weft release control means for detecting the timing at which insertion of the weft commences;

weft leading end arrival timing detecting means including a weft detector disposed at a predetermined weft insertion terminal position for detecting the timing at which the leading end of the weft arrives at said terminal position;

input means for inputting: a first group of sequential arrayed data resulting from orderly classification of data for weft insertion start timing and weft leading end arrival timing in accordance with a sequencing rule; and a second group of sequential control elements resulting from classification of control elements relating to control quantities for at least weft release timing at which the weft is released from the weft retaining action exerted by said weft release means, and air jet ejection timing at which said air jet is injected by said main inserting nozzle, both of said timing affecting said weft insertion timing and said weft leading end timing, respectively;

control quantity determining means including a control computer for (a) determining specific data for said weft insertion start timing and said leading end arrival timing in said first group of sequential arrayed data as well as likelihood values of said data on the basis of values determined experimentally for said weft insertion start timing and said weft leading end arrival timing, (b) selecting from said second group those of said control elements which bear specific correspondence relations to said determined specific data, and (c) determining control quantities for said weft release timing and said air jet injection timing on the basis of said selected control elements and said determined likelihood value; and a plurality of auxiliary weft inserting nozzles disposed downstream of said main inserting nozzle in the direction in which said weft is inserted, a weft propulsion nozzle disposed upstream of said main inserting nozzle in alignment therewith;

said predetermined weft insertion terminal position being located downstream of said auxiliary weft inserting nozzles, said control computer, on the basis of the weft insertion start timing detected by said weft release detector and the weft leading end arrival timing detected by said weft detector, controls:

the weft release timing of said weft release control means, the air jet injection timing of said main inserting nozzle, the air injection timing ($\theta_{31}$) of said propulsion nozzle and the air injection stop timing of said auxiliary weft inserting nozzles, and said control computer comprises:

(a) sampling means for sampling a predetermined number of times a weft insertion start timing signal obtained from said weft release detector and said weft leading end arrival timing signal obtained from said weft detector, and (b) calculating means for calculating mean values (x, y) of said sampled weft insertion start timing and said weft leading end arrival timing, respectively, for every predetermined number of samplings, and determining the set of relevant weft insertion start timing data ($G_m$) to which said calculated weft insertion start timing value (x) belongs and the set of relevant weft leading end arrival timing data ($H_n$) to which said calculated weft leading end arrival time value (y) belongs, wherein likelihood ratios $\{g_m(x), g_{m+1}(x), h_n(y), h_{n+1}(y)\}$ are arithmetically determined in accordance with functions ($g_m$, $g_{m+1}$) corresponding to said relevant weft insertion start timing data ($G_m$, $G_{m+1}$) and functions ($h_n$, $h_{n+1}$) corresponding to said relevant weft leading end arrival timing data ($H_n$, $H_{n+1}$).

* * * * *

UNITED STATES PATENT AND TRADEMARK OFFICE

CERTIFICATE OF CORRECTION

PATENT NO. : 5,295,515
DATED : March 22, 1994
INVENTOR(S) : Kato

It is certified that error appears in the above-indentified patent and that said Letters Patent is hereby corrected as shown below:

On the title page, item [54] and column 1, line 3, change "INSERTION IN JET LOOM" to --INSERTION START TIMING IN A JET LOOM--.

Column 3, line 24, change "above mentioned" to read --abovementioned--.

Column 9, line 21, before "$h_{n+1}$ (Y)" insert --$h_n$ (Y),--; line 36 after "means" insert comma --,--.

Column 12, line 34, change "30°", to --"30",--.

Signed and Sealed this

Twenty-third Day of August, 1994

*Attest:*

*Attesting Officer*

BRUCE LEHMAN

*Commissioner of Patents and Trademarks*